US010947924B2

(12) United States Patent
Cattermole et al.

(10) Patent No.: US 10,947,924 B2
(45) Date of Patent: Mar. 16, 2021

(54) ENGINE EXHAUST VALVE SHIELD

(71) Applicant: Ford Global Technologies, LLC, Dearborn, MI (US)

(72) Inventors: Ian Cattermole, Brighton, MI (US); Paul Thomas Reinhart, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 312 days.

(21) Appl. No.: 14/735,509

(22) Filed: Jun. 10, 2015

(65) Prior Publication Data

US 2016/0363093 A1 Dec. 15, 2016

(51) Int. Cl.
*F02F 1/24* (2006.01)
*F01L 3/08* (2006.01)

(52) U.S. Cl.
CPC ..... *F02F 1/24* (2013.01); *F01L 3/08* (2013.01); *F02F 2001/244* (2013.01)

(58) Field of Classification Search
CPC .... F02M 61/168; B22F 5/008; F02F 2200/02; F02F 2200/04; F02F 2200/06; F02F 2200/08; F02F 2200/11; F02F 1/24; F02F 2001/244; F02F 2001/248; F02F 2001/249; F02F 7/00; F02F 1/42; F02F 1/4214; F02F 1/4264; F02F 7/0087; F02F 2001/247; Y10T 29/4927; Y10T 29/49272; Y10T 428/2982; Y10T 428/249969; Y10T 428/249971; Y10T 428/249974; Y10T 428/249973; Y10T 428/249967; Y10T 428/24999; Y10T 428/24997; Y10T 428/249982; Y10T 428/2993; Y10T 428/252; Y10T 29/49389; Y10T 428/257; F02N 3/00; F01L 3/08; F01L 3/12; F01L 3/00; F01L 2101/02; F16K 41/00; F16K 41/02; F16J 15/18; F16J 15/20; F01P 3/14; F01P 3/00; B22C 1/22; B22C 1/00; B22C 1/16; B22C 9/00; B22D 19/00; B22D 19/08; B22D 19/0009; F02B 75/22; F02B 75/00; F02B 3/06; F02B 2075/025; F02B 2275/16; F01N 7/10; F01N 13/102; F05C 2251/048

(Continued)

(56) References Cited

U.S. PATENT DOCUMENTS 2,707,944 A 5/1955 Brantingham
2,797,677 A * 7/1957 Gordon ..... F01L 3/08 123/188.7

(Continued)

FOREIGN PATENT DOCUMENTS

CN 1348054 A 5/2002
GB 568940 A * 4/1945 ..... F01L 3/08
GB 568940 A * 4/1945 ..... F01L 3/08

*Primary Examiner* — Joseph J Dallo
*Assistant Examiner* — Scott A Reinbold
(74) *Attorney, Agent, or Firm* — Brooks Kushman P.C.; Geoffrey Brumbaugh

(57) ABSTRACT

An internal combustion engine has a cylinder head defining an exhaust valve guide bore with a side wall and an end wall, and an exhaust valve stem passage extending between an exhaust port and the end wall of the bore. A diameter of the passage is less than a diameter of the bore. An exhaust gas valve guide is positioned in the bore and spaced apart from the end wall to form an air gap therebetween.

14 Claims, 3 Drawing Sheets

(58) Field of Classification Search
USPC ... 123/260, 266, 142.5, 193.5, 41.74, 193.6, 123/90.15, 193
See application file for complete search history.

(56) References Cited

U.S. PATENT DOCUMENTS

| | | | | | |
|---|---|---|---|---|---|
| 2,807,253 | A * | 9/1957 | Etchells | F01L 3/08 | 123/188.9 |
| 3,728,994 | A * | 4/1973 | Bachle | F01L 3/12 | 123/188.2 |
| 3,799,139 | A * | 3/1974 | Kuhn | F01L 3/16 | 123/188.9 |
| 4,184,328 | A * | 1/1980 | Rezy, Jr. | F01N 3/34 | 123/188.9 |
| 4,394,023 | A | 7/1983 | Hinojosa | | |
| 5,239,956 | A | 8/1993 | Keelan et al. | | |
| 5,435,280 | A | 7/1995 | Hackett et al. | | |
| 5,460,139 | A * | 10/1995 | Marlin | F01L 3/08 | 123/188.3 |
| 6,125,810 | A * | 10/2000 | Haselkorn | F01L 3/02 | 123/188.6 |
| 7,980,209 | B2 * | 7/2011 | Koneda | F01L 1/16 | 123/90.11 |
| 7,997,248 | B2 | 8/2011 | Rexavier et al. | | |
| 2007/0097589 | A1 * | 5/2007 | Maerky | F01L 9/04 | 361/160 |

* cited by examiner

ENGINE EXHAUST VALVE SHIELD

TECHNICAL FIELD

Various embodiments relate to an exhaust valve in a cylinder head of an internal combustion engine.

BACKGROUND

Engine exhaust valves have valve stem guides that are often provided flush with a wall of an engine exhaust port. The guide is exposed to the high temperature exhaust gases and may have wear issues, distortion, and reduced mechanical properties due to a high temperature of the guide. Various techniques have been used to reduce exhaust valve guide wear by controlling the exhaust valve or valve guide temperature and include: guide and stem material selection, valve to stem clearance control, positioning a cooling jacket adjacent to the guide, or using a cooling jacket generally to reduce overall cylinder head distortion.

SUMMARY

In an embodiment, an engine is provided with a cylinder head defining an exhaust valve guide bore having a side wall and an end wall, and an exhaust valve stem passage extending between an exhaust port and the end wall of the bore. A diameter of the passage is less than a diameter of the bore. The engine has an exhaust gas valve guide positioned in the bore and spaced apart from the end wall.

In another embodiment, a cylinder head is provided with an exhaust gas valve guide shield that extends between an exhaust port and a bore sized to receive a valve guide. The shield extends radially inwards from a continuous side wall of the bore to form a valve stem passage. A first side of the shield forms a portion of a wall of the exhaust port. A second side of the shield forms an end wall of the bore. An exhaust gas valve guide is positioned in the bore and spaced apart from the end wall to form an air gap defined by an end of the guide, the end wall of the bore, and the side wall of the bore.

In yet another embodiment, a method of forming an engine is provided. A valve guide bore is formed with a valve stem passage extending between the bore and an exhaust port into a cylinder head. A diameter of the passage is less than a diameter of the bore such that an end wall of the bore surrounds the passage. An exhaust valve guide is positioned into the bore with the guide spaced apart from the end wall of the bore.

DETAILED DESCRIPTION

As required, detailed embodiments of the present disclosure are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
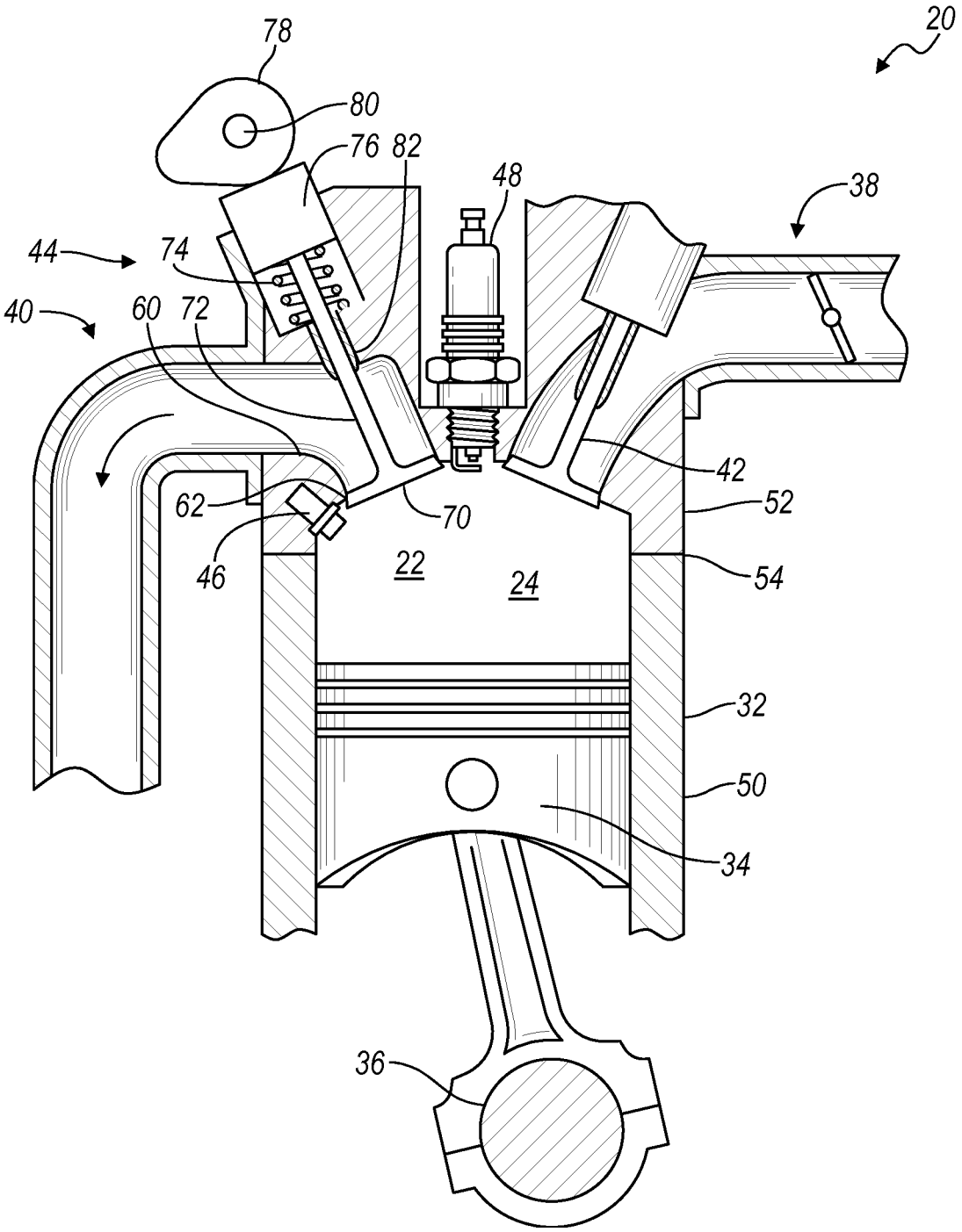
FIG. 1 illustrates a schematic of an internal combustion engine capable of implementing the disclosed embodiments.

FIG. 1 illustrates a schematic of an internal combustion engine 20. The engine 20 has a plurality of cylinders 22, and one cylinder is illustrated. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. One or more intake valves 42 controls flow from the intake manifold 38 into the combustion chamber 30. One or more exhaust valves 44 controls flow from the combustion chamber 24 to the exhaust manifold 40. The intake and exhaust valves 42, 44 may be operated in various ways as is known in the art to control the engine operation. The operation of the exhaust valve 44 is described in greater detail below.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. The spark plug 48 may be located in various positions within the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, valve timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP) sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. The piston 34 position at the top of the cylinder 22 is generally known as top dead center (TDC). The piston 34 position at the bottom of the cylinder is generally known as bottom dead center (BDC).

During the intake stroke, the intake valve 42 opens and the exhaust valve 44 closes while the piston 34 moves from the top of the cylinder 22 to the bottom of the cylinder 22 to introduce air from the intake manifold to the combustion chamber.

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 has an engine cylinder block 50 and a cylinder head 52. A head gasket 54 is interposed between the cylinder block 50 and the cylinder head 52 to seal the cylinders 22.

The cylinder head 52 defines an exhaust gas port 60. The exhaust gas port 60 provides a passage for flow of exhaust gases from each cylinder 22 to the exhaust manifold 40. The exhaust gas port has a seat 62. The seat 62 acts as an opening into the combustion chamber 24 that cooperates with the exhaust valve 44 to seal the port 60 or prevent flow of exhaust gases into the port 60 when the exhaust valve 44 is "seated" against the seat 62.

The engine 20 is illustrated as having the exhaust valve 44 as a poppet type valve in a direct overhead cam configuration. The engine and exhaust valve 44 may be configured in various manners as is known in the art, for example, as a single overhead camshaft, dual overhead camshaft, direct camshaft actuation, an overhead valve configuration with the valves operated by pushrods or rockers, and the like. The valve 44 is shown as being mechanically operated by the camshaft; however, in other examples, the valve 44 may be hydraulically or electrically controlled.

The valve 44 has a head 70 that is connected to an end of a valve stem 72. The head 70 may have various shapes, and is sized to mate with the seat 62 when the valve 44 is in a closed position. The head 70 extends radially outwardly from the stem 72.

The stem 72 is actuated by a valve mechanism. In the present example, the valve mechanism includes a spring 74 that biases the head 70 towards an open position with the head 70 unseated from the seat 62 to allow exhaust gases from the cylinder 22 into the exhaust port 60.

The valve mechanism also includes a tappet 76. The tappet 76 in the present example is a bucket style tappet. The tappet 76 has a surface that is in contact with a lobe 78 on a camshaft 80. As the camshaft 80 and lobe 78 rotate, the surface of the lobe 78 interacts with the tappet 76 to depress the tappet 76 and move the valve stem 72 and head 70 to the closed position with the head 70 seated in the valve seat 62.

The lobe 78 is shaped and sized to provide the desired valve timing, including the desired lift and duration for the valve 44. In other examples, the valve 44 is controlled to have variable valve timing as is known in the art. The valve mechanism may also include various rockers, pushrods, and the like as are known in the art.

The valve 44 also has a valve guide 82. The guide 82 is a cylindrical sleeve that is provided within the cylinder head that maintains the position of the stem and head of the valve 44. The valve stem 72 extends through the sleeve 82. The guide 82 has an outer wall in contact with and supported by the cylinder head, and an inner wall that surrounds the valve stem 72. Clearance is provided between the inner wall of the guide 82 and the stem 72 such that the stem easily slides within the guide while preventing exhaust gases from passing through the guide. The guide 82 is sized to allow for diametrical wear over the life of the engine while maintaining clearance with and positioning of the stem 72.

In a conventional engine, the guide is typically inserted or formed with the cylinder head such that the end of the guide is flush with a wall of the exhaust port. The guide is commonly made from steel, steel alloy, or another material that is wear resistant.

The valve 44 also has various seals and other components and features that are not illustrated.

Figure 2:
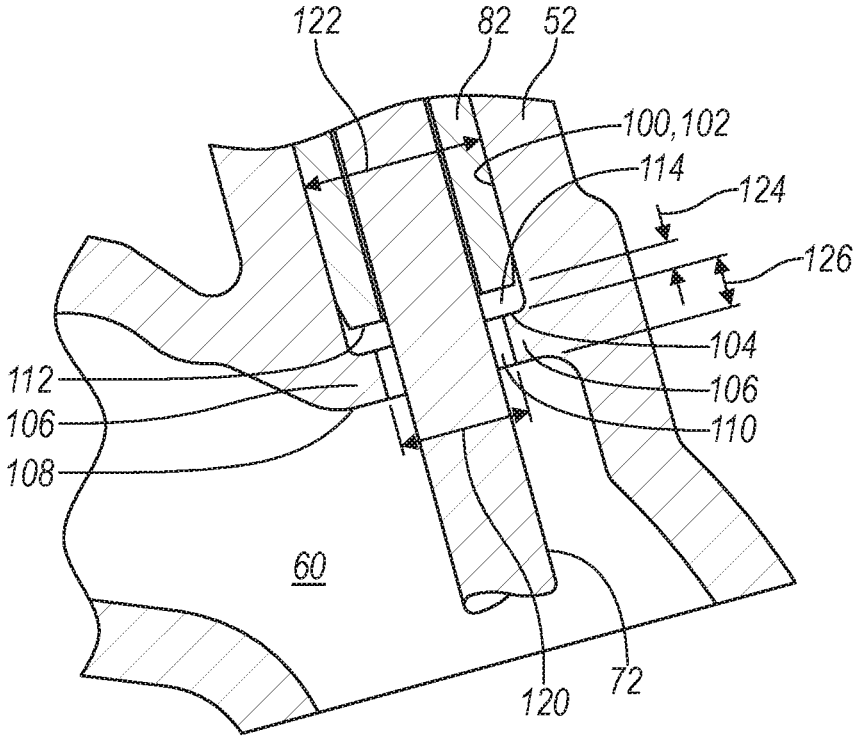
FIG. 2 illustrates a sectional view of an exhaust valve shield according to an embodiment.

FIG. 2 illustrates a partial sectional view of a cylinder head and exhaust valve according to an embodiment. Elements similar to or the same as those described above with respect to FIG. 1 are given the same reference number.

The cylinder head 52 defines an exhaust valve guide bore 100 with a side wall 102 and an end wall 104. The guide bore 100 may be provided as a cylindrical bore within the head 52, and may be machined or otherwise formed in the head. For a cylindrical bore 100, the side wall 102 is a continuous wall. In the example shown, the bore 100 has a constant diameter along the length of the bore.

The guide bore 100 is formed adjacent to an exhaust port 60 of the engine, with the end wall 104 spaced apart from the port 60 such that a shield 106 is formed therebetween. A first side of the shield 106 is formed by the bore end wall 104 and a second, opposed side of the shield 106 is formed by a wall 108 of the exhaust port 60.

An exhaust valve stem passage 110 is formed in the shield 106 and extends between the exhaust port 60 and the end wall 104 of the bore 100. The passage 110 may be cylindrical in shape. The exhaust valve stem 72 extends through the passage 110.

The end wall 104 of the bore surrounds a perimeter of the passage 110. In other words, the shield 106 extends radially inwards from the side wall 102 of the bore to form the valve stem passage 110.

The exhaust valve guide 82 is positioned within the bore 100 such that an end 112 of the guide 82 is spaced apart from the end wall 104. An air gap 114 is formed between the end 112 of the guide 82 and the end wall 104 of the bore. The air gap 114 is also bounded by a portion of the side wall 102 of the bore. The stem 72 extends through the air gap 114.

A diameter 120 of the passage 110 is less than a diameter 122 of the bore 100 or an outer diameter of the guide 82. The diameter 120 of the passage 110 is greater than an inner diameter of the guide 82 such that a greater degree of clearance is provided between the passage 110 and the stem 72.

In one example, the bore and the guide diameter is approximately ten to twelve millimeters. The passage diameter is approximately eight to ten millimeters. The passage diameter 120 is larger than a diameter of the stem 72 to allow for clearance of the stem with respect to the passage and for air or gas to enter the air gap. The clearance may be sized to a minimum amount to reduce debris or the like from crossing into the air gap 114. In other examples, the diameter 120 may be larger than the minimum clearance needed for the stem 72 to control the temperature of the guide 82. The stem may be approximately five to six millimeters in diameter, and a clearance of one to two millimeters, or 1.5 to 2.0 millimeters may be provided between the surface of the stem 72 and the surface of the passage 110.

A width 124 of the air gap 114 may be less than a thickness 126 of the shield 106. In one example, as shown, the air gap 114 has a width of one to two millimeters, and may be 1.5 millimeters, while the shield is three or more millimeters in thickness. The size of the air gap may be selected to control the temperature of the guide 82. The size of the shield may have a minimum valve based on manufacturing and engine operating temperature material limitations. The size of the shield may also be selected to control the temperature of the guide 82.

Of course, in other examples, the dimensions of the engine and valve components and the spacing may vary.

The engine exhaust gas temperatures in the exhaust port during engine operation may be in the range of 900-1050 degrees Celsius. The shield 106 and air gap 114 cooperate to provide a thermal barrier or insulating feature for the guide 82. The air gap 114 is positioned between the shield and the guide to provide a setback region for the guide, and reduce heat transfer due to conduction through the port walls to the guide. By reducing the heat transferred to the guide 82 during engine operation, and lowering the temperature of the guide 82, wear at the end 112 region of the guide caused by the motion of the stem 72 may be reduced. However, if the temperature of the guide 82 is lowered too much, the stem 72 may cause wear on the inner surface of the guide due to a smaller degree of thermal expansion of the guide and friction.

Generally, exhaust valve guide 82 wear may be aggravated by a reduction in mechanical properties and increased thermal distortion at the lower portion adjacent to the end 112 of the guide 82 resulting from exposure to a direct stream of exhaust gas in the exhaust port 60 from the combustion chamber that leads to wear of the exhaust valve guide. Wear on the exhaust valve guide may lead to wear of the valve seat 62 and/or triggering an engine code in a vehicle environment.

By providing a shield 106 to the guide 82, the guide 82 is shielded from the direct flow of exhaust gas, and operates at a lower temperature with reduced distortion while maintaining a clearance between the guide 82 and the valve stem 72, retaining higher mechanical properties, and reducing guide wear. In FIG. 2, the shield 106 is provided using parent material in the cylinder head 52.

Figure 3:
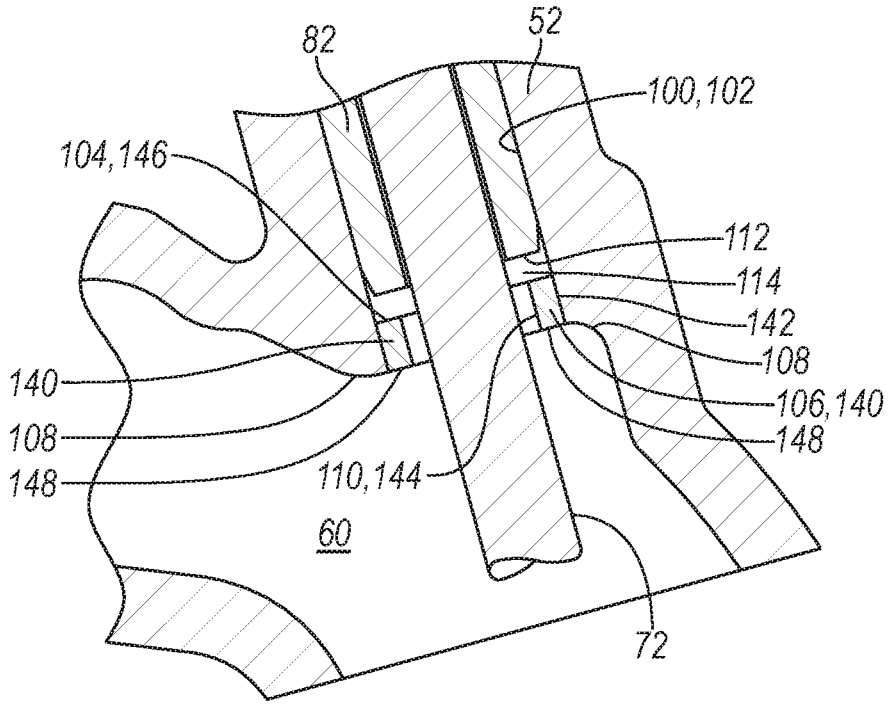
FIG. 3 illustrates a sectional view of an exhaust valve shield according to another embodiment.

FIG. 3 illustrates a partial sectional view of a cylinder head and exhaust valve according to another embodiment. Elements similar to or the same as those described above with respect to FIGS. 1 and 2 are given the same reference number.

The bore 100 is formed with a side wall that extends through to the exhaust port 60. A washer 140 or other insert is positioned in the bore 100 to provide the shield 106. The washer 140 has an outer wall 142 or outer diameter that is sized to press fit with the side wall 102 of the bore. The washer 140 also has an inner wall 144 or inner diameter that forms the valve stem passage 110. The inner wall 144 is sized to provide clearance for the stem 72 and for air or gas to enter the air gap. The clearance may be sized to a minimum amount to reduce debris or the like from crossing into the air gap 114 while maintaining a larger clearance with the valve stem 72 compared to a guide inner wall. In other examples, the size of the wall 144 may be larger than the minimum clearance needed for the stem 72 to control the temperature of the guide 82. The stem may be approximately five to six millimeters in diameter, and a clearance of one to two millimeters, or 1.5 to 2.0 millimeters may be provided between the surface of the stem 72 and the surface of the wall 144.

A first side 146 of the washer 140 provides the end wall 104 of the bore. A second, opposed side 148 of the washer 140 is positioned to be flush with an adjacent wall 108 of the exhaust port 60. Although the first and second sides 146, 148 of the washer 140 are illustrated as being planar surfaces that are oriented generally perpendicular to the axis of the valve stem 72, one or both of the sides 146, 148 may have a contoured or other complex profile shape to further control the temperature of the guide 82, for example, a convex or concave shape. The washer 140 may also be oriented at another angle relative to the stem 72.

The end 112 of the guide 82 is spaced apart from the side 146 of the washer 140 to form an air gap 114 therebetween. As described above, the air gap 114 provides a thermal insulating feature to control and limit the temperature of the guide 82 during engine operation by acting in conjunction with the washer 140 as a thermal barrier between the exhaust gases in the exhaust port 60 and the guide 82.

The washer 140 may be formed of the same material as the cylinder head 52. In the present example, the washer 140 and the cylinder head 52 are both formed from aluminum or an aluminum alloy material, although other materials are also contemplated. By making the washer 140 and the cylinder head 52 from a common material, the two components have the same or substantially the same thermal expansion characteristics, which maintains the press fit of the washer within the bore with temperature increases during engine operation. In other examples, the washer 140 may be made from a different material or alloy than the cylinder head 52; however, it may be desirable to select materials that have substantially similar thermal expansion coefficients. In further examples, the washer 140 may be coated on one or both sides or otherwise treated before insertion into the cylinder head 52 to vary the thermal properties, reduce wear on the passage 110 from the valve stem 72, etc., for example, using a ceramic coating or other coating.

Figure 4:
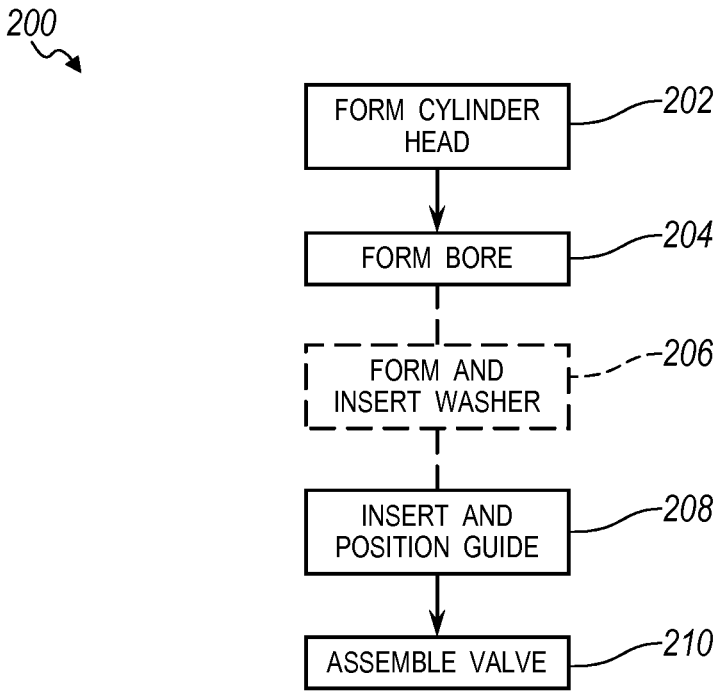
FIG. 4 illustrates a flow chart for forming an engine with the valve shield according to FIG. 3 or 4.

FIG. 4 illustrates a flow chart of a method 200 of forming a cylinder head according to various embodiments. In other embodiments, various steps in the method 200 may be combined, rearranged, or omitted.

A cylinder head is formed at step 202. The cylinder head may be formed using various processes, and in one example, is formed from aluminum using a casting process. The cylinder head may be formed using a die casting process, lost core casting process or the like where various passages, such as exhaust port 60, are formed within the head.

At step 204, the bore 100 is formed in the cylinder head 52. The bore 100 may be formed using a machining process such as drilling or milling.

For the embodiment as illustrated in FIG. 2, the bore 100 and exhaust passage 110 may be machined or formed in a two step process at step 204 with the method then proceeding to step 208. The passage 110 is formed or machined with a smaller diameter than the bore 100. In one example, the bore 100 is machined as a blind bore, and the passage 110 is then machined into the end wall between the bore 100 and the port 60. In another example, the passage 110 is formed first by machining the passage to a first depth extending through to the port 60, and the bore 100 is then machined to a second depth less than the first depth to forming the end wall of the bore.

For the embodiment as illustrated in FIG. 3, the bore 100 may be machined or formed at step 204 with the method then proceeding to step 206. The bore 100 may be machined as a through hole such that it extends through to the exhaust port 60.

At step 206, for the embodiment as illustrated in FIG. 3, a washer 140 is formed for example, using a casting, forging, machining or other process. Note that step 206 is omitted for the embodiment shown in FIG. 2, and step 206 is therefore drawn as broken lines.

At step 206, the washer 140 may be formed using the same or a substantially similar material as was used to form the cylinder head, for example, a metal, metal alloy, aluminum, aluminum alloy, or the like. The washer 140 is formed with an outer diameter sized to press fit into the bore 100. The passage 110 is formed through the washer to provide in inner wall or diameter of the washer 140. The passage 110 may be formed at the same time as the washer, or in a later machining step. The washer is pressed or otherwise inserted into the bore 100 such that one side of the washer is substantially flush with an adjacent wall of the exhaust port 60, and the other side of the washer forms an end wall of the bore.

Note that the size of the passage 110 formed in the end wall of the bore or the washer has a minimum diameter to provide the necessary clearance between the valve stem and the wall of the passage. The diameter of the passage 110 may be sized to be larger than the minimum diameter to control a temperature of the guide during engine operation. The diameter may be selected or increased above the minimum size to allow for additional exhaust gases to flow into the air gap and control the temperature of the guide during engine operation.

At step 208, the guide 82 is positioned in the bore 100 with the guide spaced apart from the end wall of the bore or the washer to form an air gap between the end of the guide 82 and the end wall provided by the bore or the washer. The air gap is further defined by the continuous side wall of the bore. The guide is positioned to provide a desired size for the air gap. For example, a width of the air gap between the end of the guide and the end wall of the bore may be sized to control a temperature of the guide during engine operation.

At step 210, the valve 44 may be assembled into the cylinder head 52, for example, by inserting the valve stem through the guide, and attaching the springs, tappets, and the like. The cylinder head 52 may be attached to the block to form the engine in a vehicle.

While exemplary embodiments are described above, it is not intended that these embodiments describe all possible forms of the invention. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An engine comprising:

a cylinder head defining an exhaust valve guide bore having a continuous, cylindrical side wall intersecting a wall of an exhaust port;

a cylindrical washer having an outer diameter sized to be press fit with the side wall of the bore such that an outer face of the washer is flush with the wall of the exhaust port adjacent thereto, the washer defining an exhaust valve stem passage having a diameter less than a diameter of the bore; and an exhaust gas valve guide spaced apart from an inner face of the washer to form an air gap therebetween and having a cylindrical outer wall circumferentially contacting the side wall;

wherein a coating is provided on at least one of the inner and outer faces of the washer, the coating configured to control a temperature of the guide during engine operation; and wherein a length of the air gap between the guide and the washer is sized to control a temperature of the guide during engine operation to reduce heat transferred to the guide while preventing overcooling and provide thermal expansion of the guide to reduce wear.

2. The engine of claim 1 wherein the washer forms a valve guide shield that extends between the exhaust port and the valve guide bore.

3. The engine of claim 1 further comprising an exhaust gas valve stem extending through the guide and the exhaust valve stem passage and into the exhaust port.

4. A cylinder head comprising:

a washer configured as an exhaust gas valve guide shield, the washer extending between an exhaust port and a bore sized to receive a valve guide, the washer having an outer diameter sized for a press fit with a continuous side wall of the bore and extending radially inwards to form a valve stem passage, a first side of the washer positioned to be flush with an adjacent wall of the exhaust port, a second side of the washer forming an end wall of the bore; and an exhaust gas valve guide positioned in the bore and having a cylindrical outer wall extending to an end of the guide, the cylindrical outer wall circumferentially contacting the side wall of the bore, the end of the guide spaced apart from the second side of the washer to form an air gap defined by the end of the guide, the second side of the washer, and the side wall of the bore.

5. The cylinder head of claim 4 wherein the washer further comprises a coating on at least one of the first and second sides of the washer, the coating configured to control a temperature of the guide during engine operation.

6. The cylinder head of claim 4 wherein an inner diameter of the guide is less than a diameter of the passage; and wherein a width of the air gap is less than a thickness of the washer.

7. The engine of claim 1 wherein the exhaust gas valve guide is formed by a cylindrical sleeve having the cylindrical outer wall extending from a first end to a second end of the guide.

8. The cylinder head of claim 5 wherein the adjacent wall of the exhaust port is without the coating.

9. The cylinder head of claim 5 wherein the second side of the washer is planar.

10. The cylinder head of claim 9 wherein the first side of the washer is planar.

11. The cylinder head of claim 4 wherein the washer has a cylindrical outer wall extending from the first side to the second side of the washer.

12. The cylinder head of claim 4 wherein the side wall of the bore has a constant diameter.

13. The cylinder head of claim 4 further comprising sizing a length of the air gap between the end of the guide and the end wall of the bore to control a temperature of the guide during engine operation, the length sized to reduce heat transferred to the guide while preventing overcooling and allow for thermal expansion of the guide to reduce wear.

14. The cylinder head of claim 13 further comprising sizing a diameter of the valve stem passage to control the temperature of the guide during engine operation while maintaining a minimum clearance between a valve stem and the valve stem passage, the diameter sized to reduce heat transferred to the guide while preventing overcooling and allow for thermal expansion of the guide to reduce wear.

* * * * *